US012392207B2

(12) United States Patent
Nguyen et al.

(10) Patent No.: US 12,392,207 B2
(45) Date of Patent: Aug. 19, 2025

(54) ANCHOR, METHOD, AND SYSTEM

(71) Applicant: Baker Hughes Oilfield Operations LLC, Houston, TX (US)

(72) Inventors: Tuan Nguyen, Pearland, TX (US); James Scott Trahan, Magnolia, TX (US); Keith J. Murphy, Hartford, CT (US)

( * ) Notice: Subject to any disclaimer, the term of this patent is extended or adjusted under 35 U.S.C. 154(b) by 0 days.

(21) Appl. No.: 18/508,901

(22) Filed: Nov. 14, 2023

(65) Prior Publication Data

US 2025/0154839 A1 May 15, 2025

(51) Int. Cl.
*E21B 23/01* (2006.01)
*E21B 23/04* (2006.01)

(52) U.S. Cl.
CPC ..... *E21B 23/01* (2013.01); *E21B 23/0411* (2020.05)

(58) Field of Classification Search
CPC .... E21B 23/01; E21B 23/0411; E21B 23/042; E21B 33/126; E21B 33/129–12955
See application file for complete search history.

(56) References Cited

U.S. PATENT DOCUMENTS 1,170,294 A * 2/1916 Louden ..... E21B 31/20 294/86.19
1,638,494 A * 8/1927 Lewis ..... E21B 23/042 166/55.3
2,111,076 A * 3/1938 Posey ..... E21B 31/107 166/117.7
3,381,751 A * 5/1968 McLelland ..... E21B 23/06 166/66.4
7,331,386 B2 * 2/2008 Kanayama ..... E21B 23/01 166/254.2
7,757,767 B2 * 7/2010 Hill ..... E21B 23/01 166/212
9,518,437 B2 * 12/2016 Hallundbæk ..... E21B 23/14
10,094,189 B2 * 10/2018 Kartha ..... E21B 23/01
12,044,085 B1 * 7/2024 Tang ..... E21B 7/06
2006/0131015 A1 * 6/2006 Kanayama ..... E21B 23/01 166/301
2009/0223659 A1 * 9/2009 Hill ..... E21B 23/01 166/55.1
2012/0211245 A1 * 8/2012 Fuhst ..... E21B 23/01 166/217
2014/0014315 A1 * 1/2014 Hallundbæk ..... E21B 23/01 166/241.1

(Continued)

FOREIGN PATENT DOCUMENTS

CN 108119066 A * 6/2018 ..... E21B 12/00
CN 110056379 A * 7/2019 ..... E02D 5/74
CN 113123745 A * 7/2021 ..... E21B 23/01

(Continued)

*Primary Examiner* — Jennifer H Gay
(74) *Attorney, Agent, or Firm* — Baker Hughes Company

(57) ABSTRACT

An anchor, including a housing, a slip in contact with the housing, and a power drive gear mounted in the housing and disposed to drive the slip. A method for operating an anchor, including supplying an input to the anchor, driving a slip of the anchor to a position other than a position occupied by the slip immediately prior to the input, wherein the driving comprises rotating a power drive gear. A wellbore system, including a borehole in a subsurface formation, a string in the borehole, and an anchor disposed within or as a part of the string.

18 Claims, 15 Drawing Sheets

(56) References Cited

U.S. PATENT DOCUMENTS

| | | | | |
|---|---|---|---|---|
| 2017/0074062 | A1* | 3/2017 | Kartha | E21B 23/0411 |
| 2021/0301611 | A1* | 9/2021 | Nguyen | E21B 23/0421 |

FOREIGN PATENT DOCUMENTS

| | | | | | |
|---|---|---|---|---|---|
| CN | 114075938 | A | * | 2/2022 | E21B 17/1078 |
| CN | 114183101 | A | * | 3/2022 | |
| CN | 115126463 | A | * | 9/2022 | E21B 19/10 |

* cited by examiner

ANCHOR, METHOD, AND SYSTEM

BACKGROUND

In the resource recovery and fluid sequestration industries, it is often necessary to anchor tools in the downhole environment. Many devices are known to facilitate this effect. Nevertheless, improvements in devices to improve anchoring reliability, efficiency retrievability or combinations are beneficial to the art.

SUMMARY

An embodiment of an anchor, including a housing, a slip in contact with the housing, and a power drive gear mounted in the housing and disposed to drive the slip.

An embodiment of a method for operating an anchor, including supplying an input to the anchor, driving a slip of the anchor to a position other than a position occupied by the slip immediately prior to the input, wherein the driving comprises rotating a power drive gear.

An embodiment of a wellbore system, including a borehole in a subsurface formation, a string in the borehole, and an anchor disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
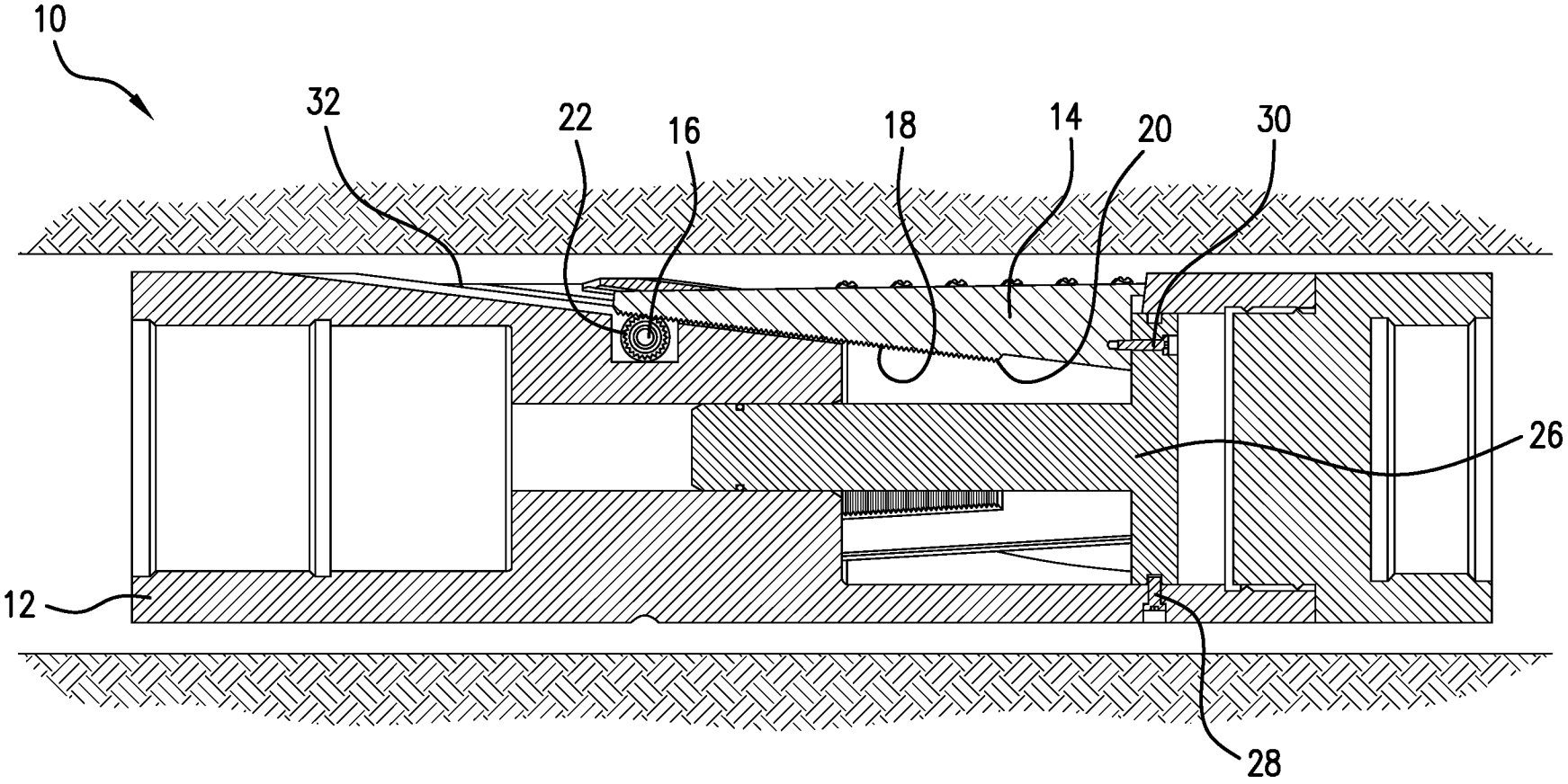
FIG. 1 is a section view of an anchor as disclosed herein in a run in position.
Figure 2:
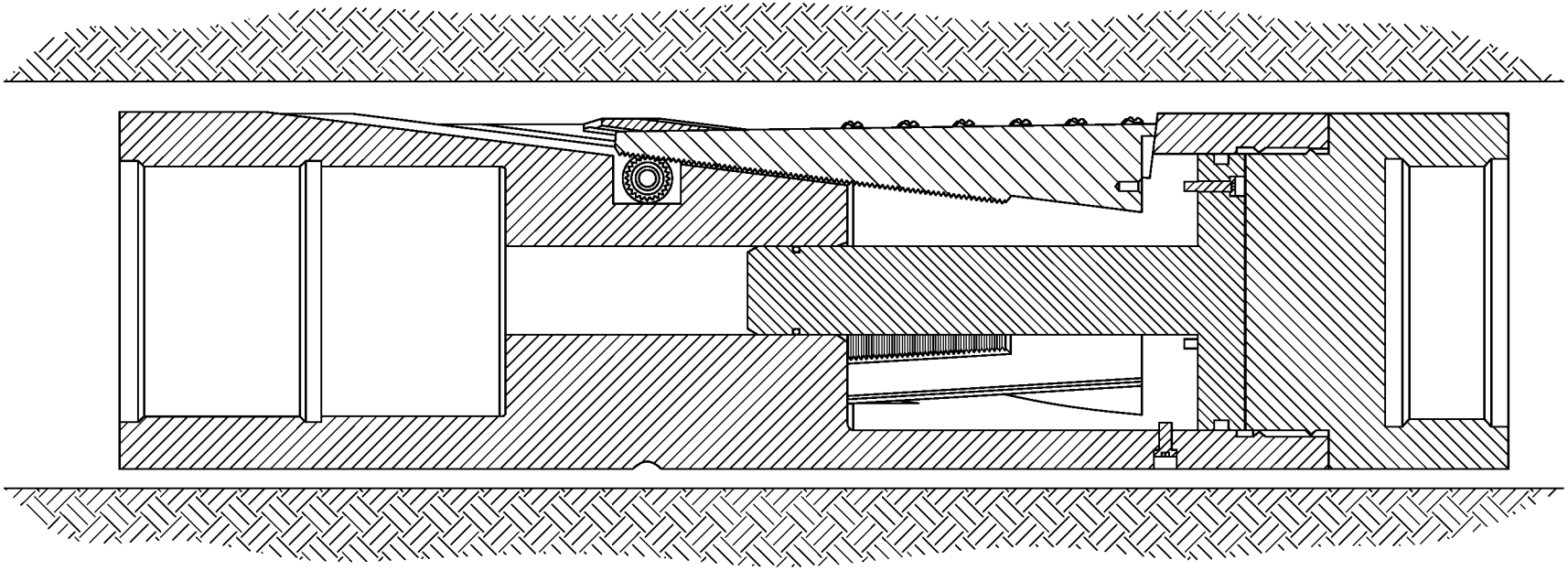
FIG. 2 is the anchor illustrated in FIG. 1 in a activating position.
Figure 3:
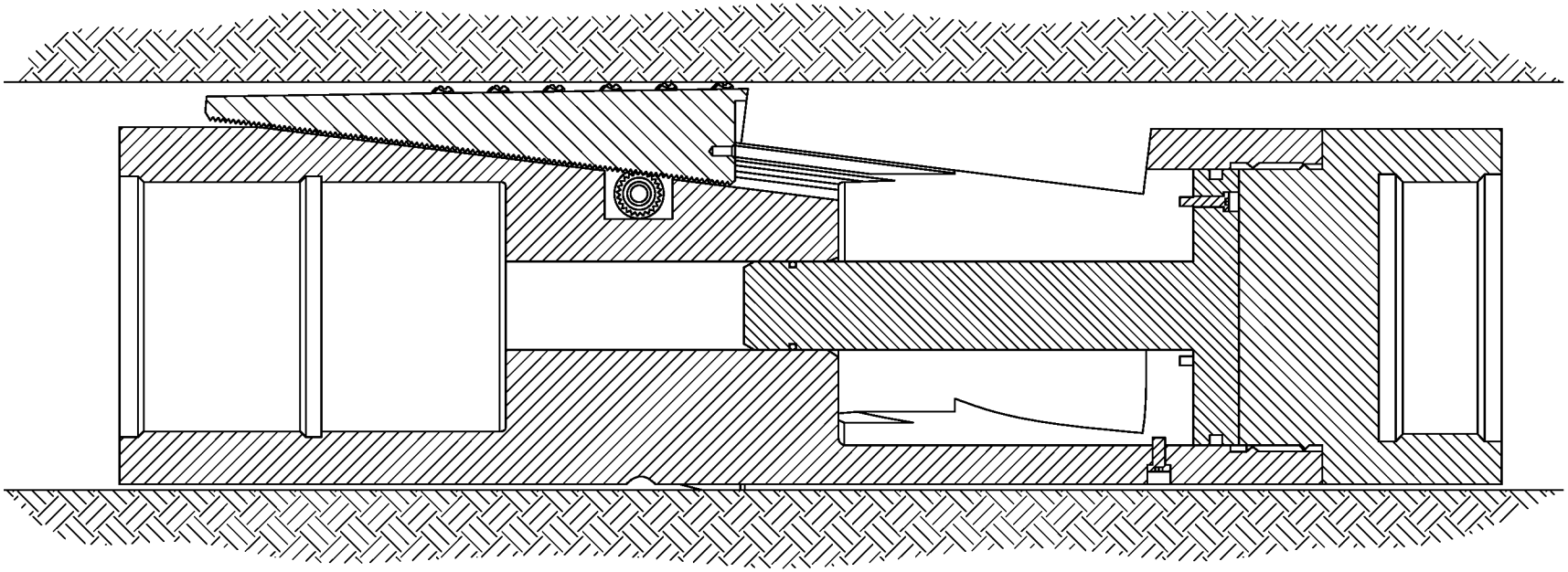
FIG. 3 is the anchor illustrated in FIG. 1 in a set position.

Referring to FIGS. 1-3, an embodiment of an anchor 10 is illustrated. The anchor 10 includes a housing 12, operably connected to which is a slip 14 and a power drive gear 16. The slip 14 includes teeth 18 at a radially inward surface 20 of the slip. The teeth 18 are complementary to teeth 22 on the power drive gear 16 such that if the power drive gear 16 rotates under power (e.g., from potential energy of a spring), the slip 14 will translate linearly along the housing 12. The power drive gear 16 may be configured to drive the slip 14 toward a set position, which will be radially outwardly displaced along a cone surface 32 of the housing 12 or may be configured to drive the slip 14 to an unset position which is radially inwardly along the surface 32 of the housing 12. A plurality of power drive gears 16 are contemplated and it is also contemplated that one or more of the plurality of power drive gears 16 may be configured to drive the slip 14 in the opposite direction to others of the plurality of power drive gears 16. In such a case, an additional construction detailed later herein will be included to allow for a selective freewheel condition for one or more of the power drive gears.

In the illustrated embodiment, a piston 26 is also disposed in the housing 12 and is releasably initially affixed to the housing 12 through piston releaser 28, which may be a shear screw or similar, and releasably affixed to the slip 14 at slip releaser 30, which may be a shear screw or similar. The piston 26 is responsive to applied pressure (e.g., hydraulic, electromechanical, etc.) in the housing through a string connected to the housing 12 illustrated schematically with the legend "activation pressure" in FIG. 2. Such pressure causes the piston to release from piston releaser 28 and to also release the slip releaser 30. In the FIG. 1 embodiment, the slip 14 will automatically deploy towards a set position based upon the power gear drive 16 driving the slip 14 up a conical surface 32 of the housing 12.

Figure 4:
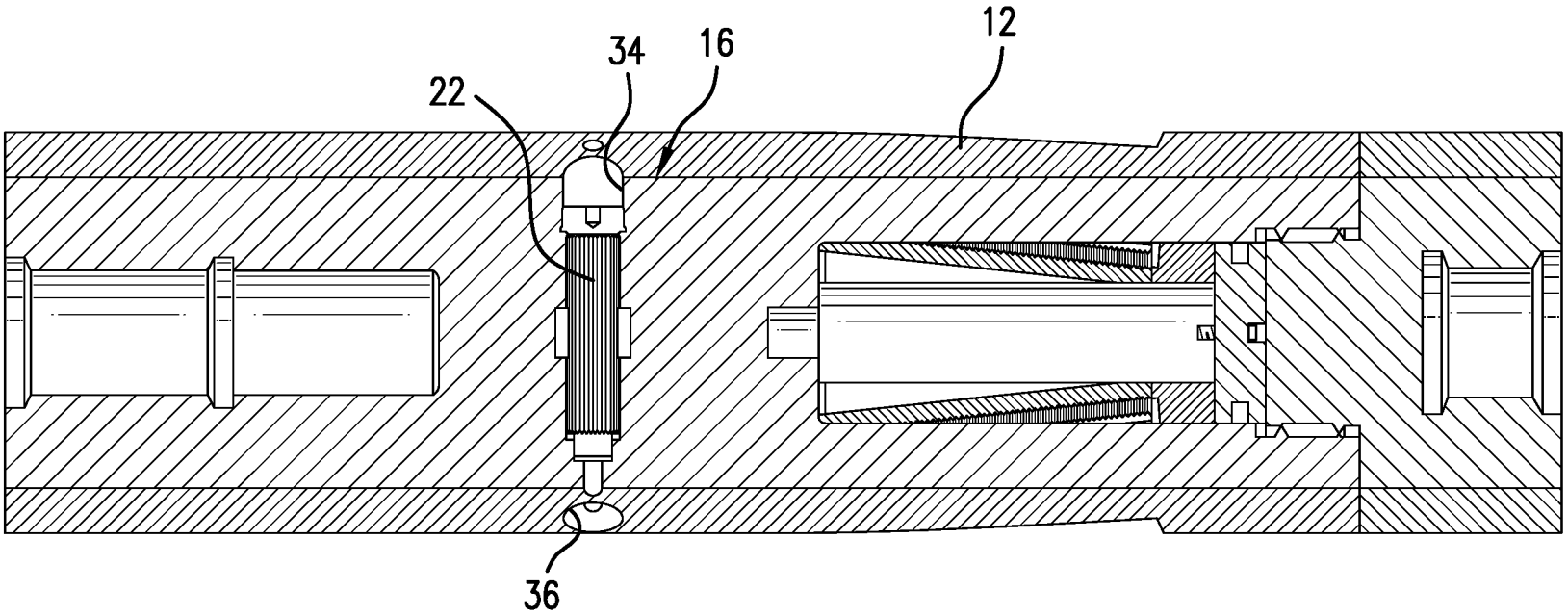
FIG. 4 is a view of the anchor in the plane of the power drive gear.
Figure 5:
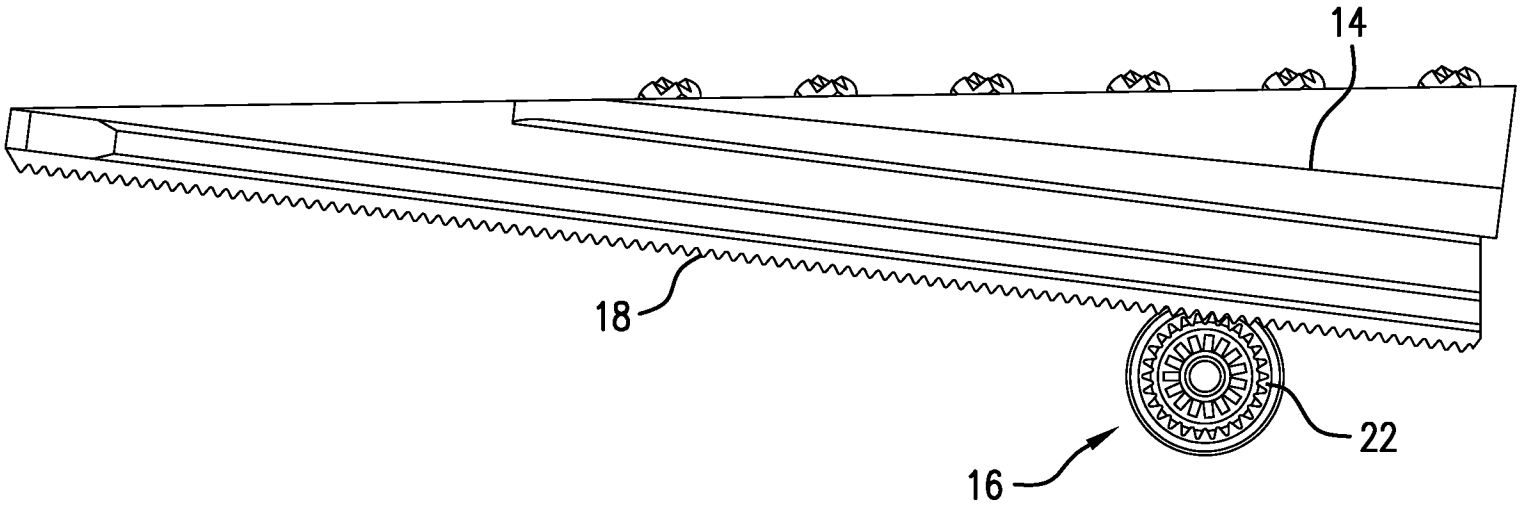
FIG. 5 is an enraged view of a slip of the anchor of FIG. 1.
Figure 6:
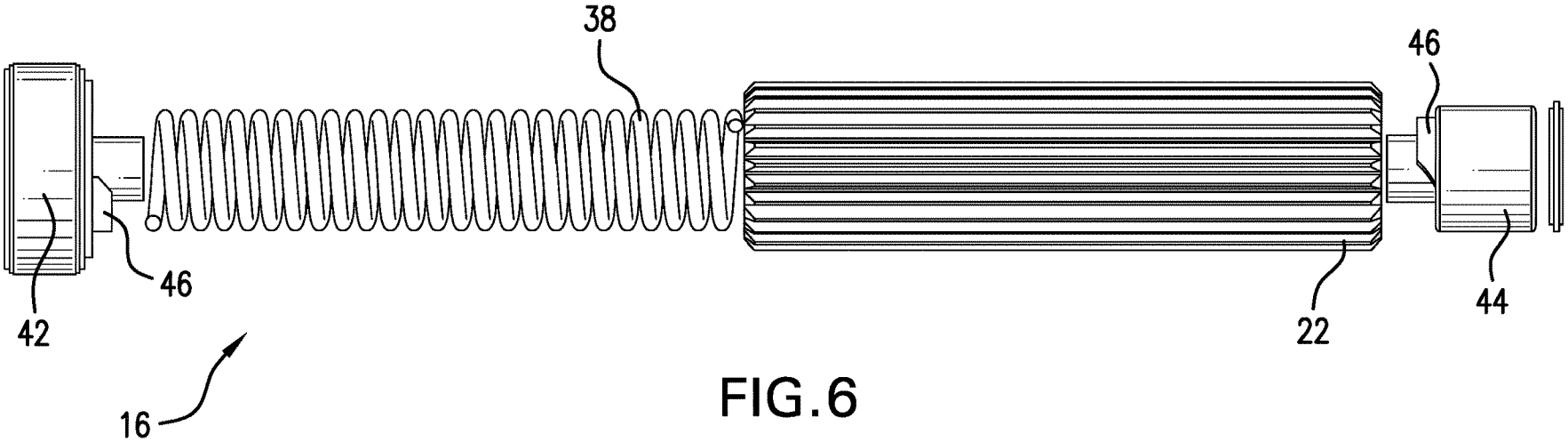
FIG. 6 is an exploded view of the power drive gear.
Figure 7:
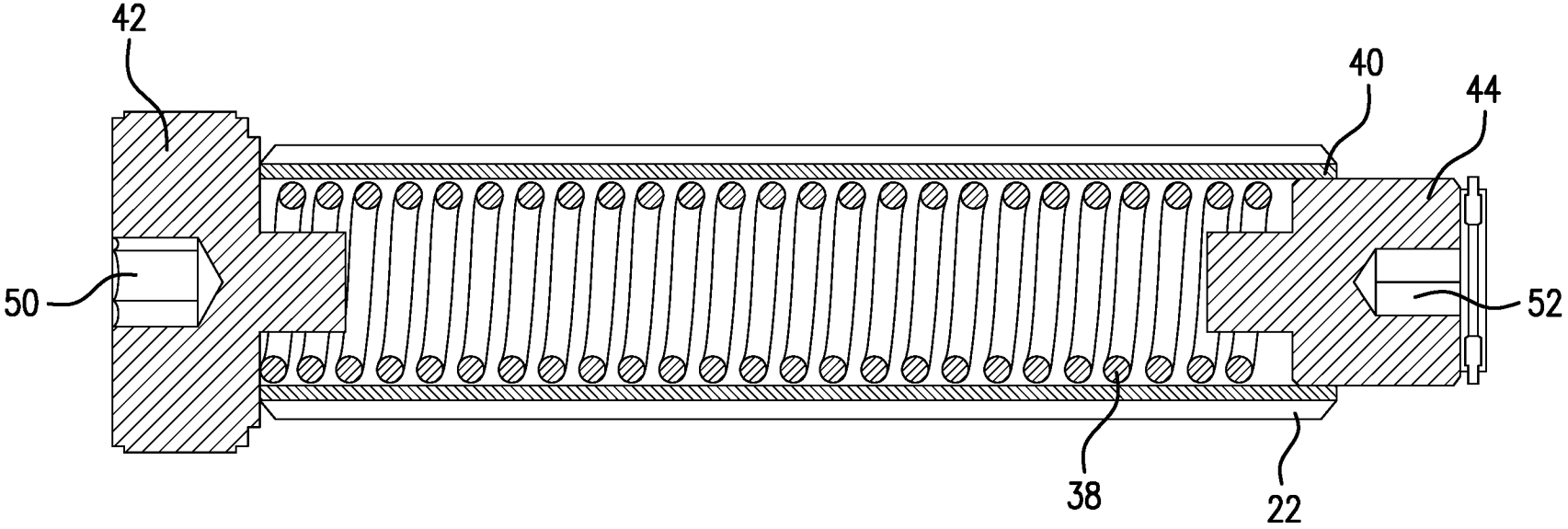
FIG. 7 is a sectional view of the power drive gear.
Figure 8:
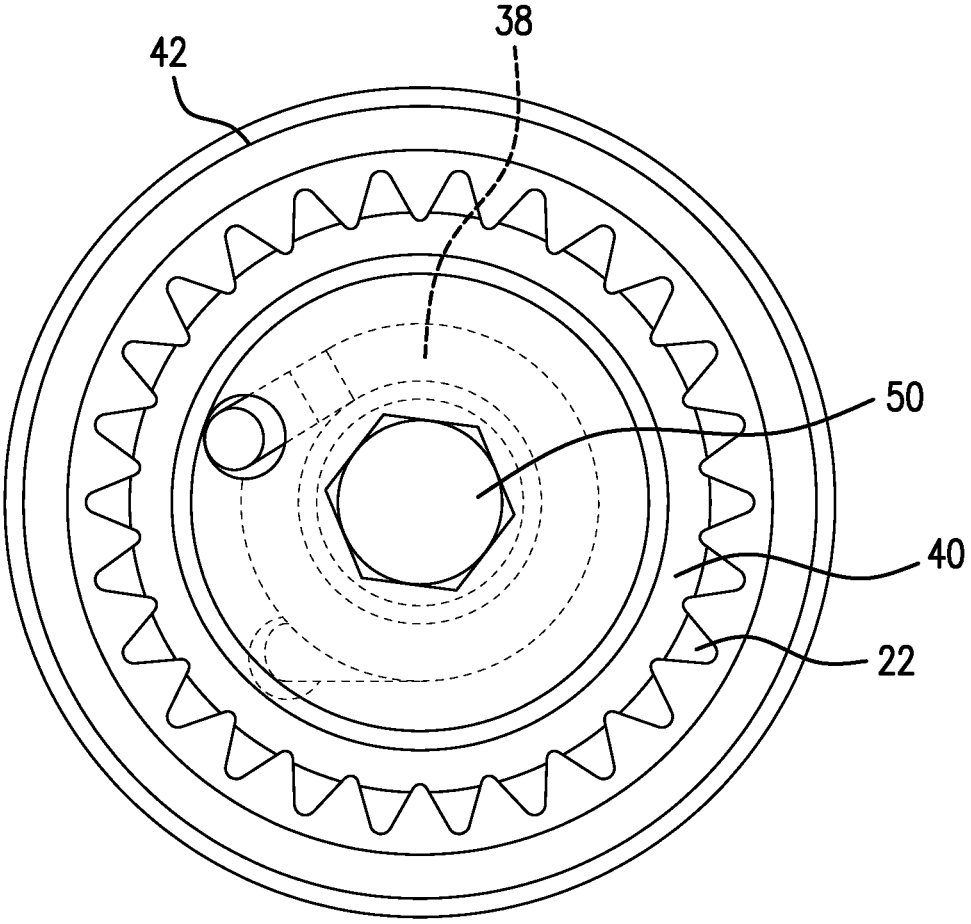
FIG. 8 is an end view of the power drive gear.

In order to further understand the power drive gear 16, reference is made to FIGS. 4-8. FIG. 4 is a schematic illustration of FIG. 1 that has been rotated 90 degrees into the page. This renders the power drive gear 16 visible in a plan view rather than the section views of FIGS. 1-3. The gear 16 is mounted in the housing 12 in bores 34 and 36 thereof that fit each end of the gear 16 as illustrated. FIG. 5 provides a better understanding of the interactive surface of the slip 14 where teeth 18 are visible and will mesh with teeth 22 on the gear 16. Referring to FIGS. 6-8 it will be appreciated that the gear 16 includes a biaser 38 (that may be a coil spring in an embodiment) that is disposed inside of a splined tube 40 and trapped therein by first and second drive plugs 42 and 44. Each plug 42 and 44 includes a buttress 46, with which the biaser 38 engages so that rotational input from one plug 42/44 while the opposite plug 42/44 will result in winding of the biaser 38. Such winding will cause the storage of potential energy that may be released as kinetic energy when it is desired to drive the slip 14 to one of its positions relative to the housing 12. Winding may occur in embodiments hereof directly from the assembly of the anchor 10 during manufacture or may occur with specific input at the time of assembly or at a later time. For specific input, note the wind inputs 50 and 52 in FIG. 7. As illustrated, these are hexagonal recesses but it will be appreciated that any geometric shape that allows torque transfer may be substituted. If the gear 16 is to be wound during manufacture as a result of the manufacturing process directly, then the gear 16 will be would by the loading of the slip 14 onto the housing. The slip will be placed in the set position and forced to slide down the cone 32 into the running position and while making that movement winding the gear 16. In such an embodiment, the gear 16 will be configured to drive the slip 14 to the set position when released as in the illustrations of FIGS. 1-3. FIG. 8 is a transparent end view for greater understanding.

Figure 9:
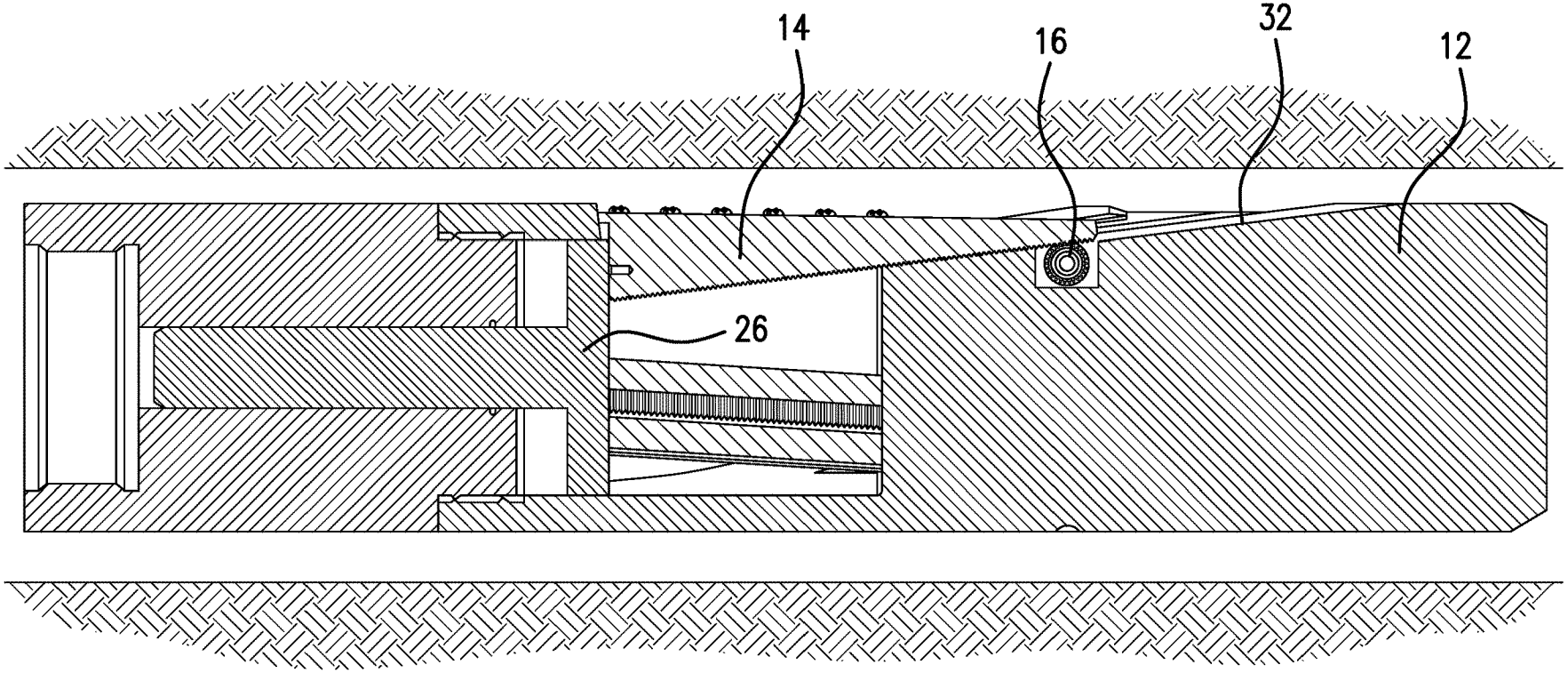
FIG. 9 is a section view of an anchor as disclosed herein in a run in position.
Figure 10:
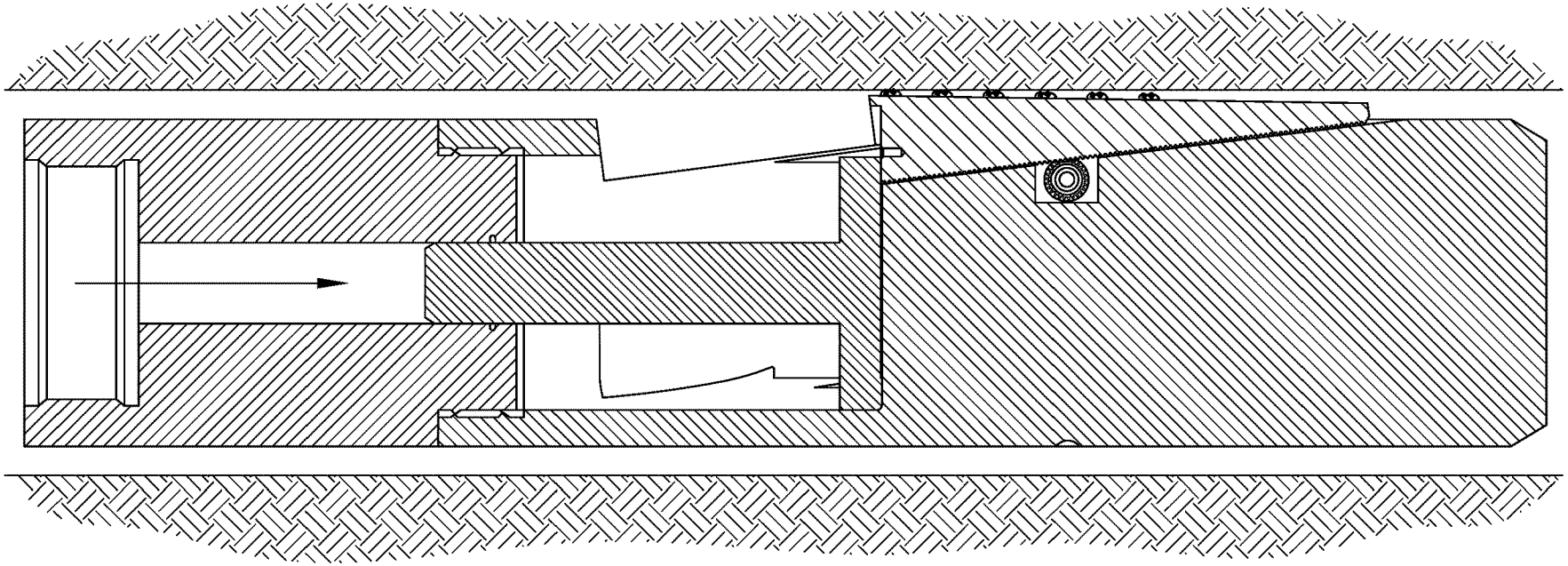
FIG. 10 is the anchor illustrated in FIG. 9 in a set position.
Figure 11:
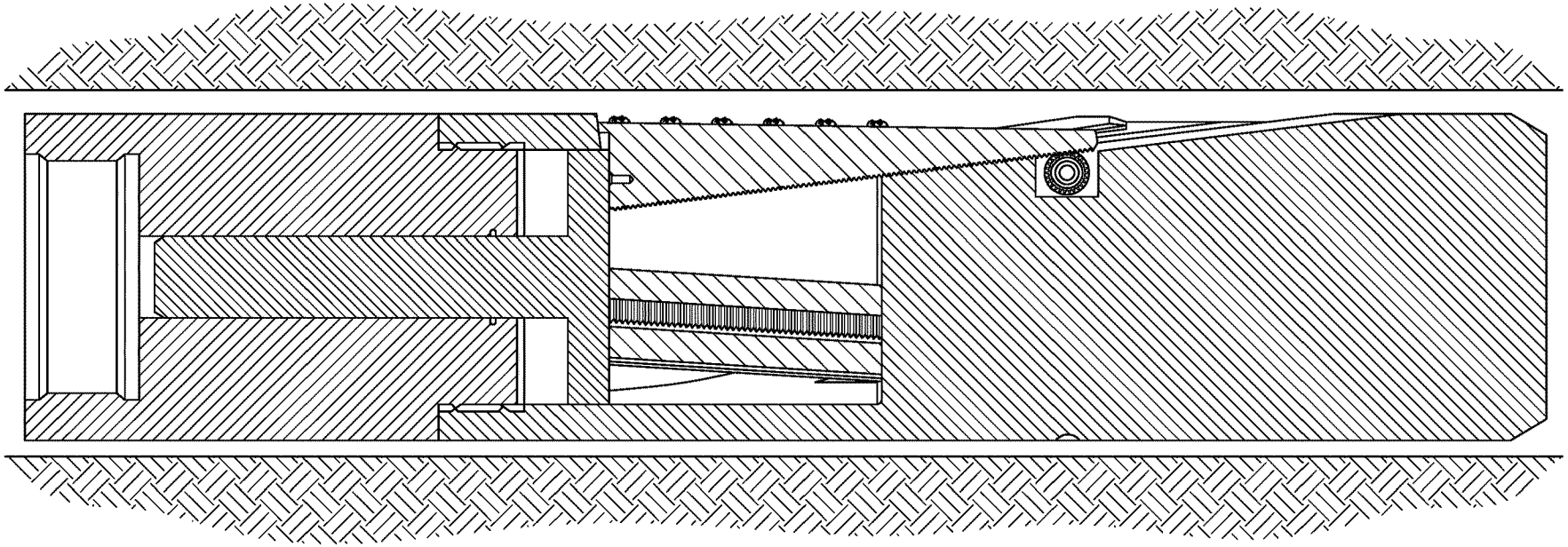
FIG. 11 is the anchor illustrated in FIG. 9 in a retracted position.

Referring now to FIGS. 9-11, an alternate embodiment is illustrated that is configured to pull the slip 14 out of the set position and into the unset position instead. As illustrated the slip 14, and cone 32 are flipped around to the opposite direction. Otherwise, components are essentially the same. The wind of the gear 16 will still try to drive the slip 14 to the left of the figure but that direction in this context, drives the slip 14 to the radially inwardly located portion of the cone 32 rather than the radially outwardly located portion as in FIG. 1. This, accordingly, tends to move the slip 14 to the running position rather than to the set position. This embodiment uses the same pressure actuation but in this case the piston 26 actually causes the set motion of the slip and upon the release of the actuation pressure, will allow the gear 16 to pull the slip back down for further running or tripping out of the hole.

Figure 12:
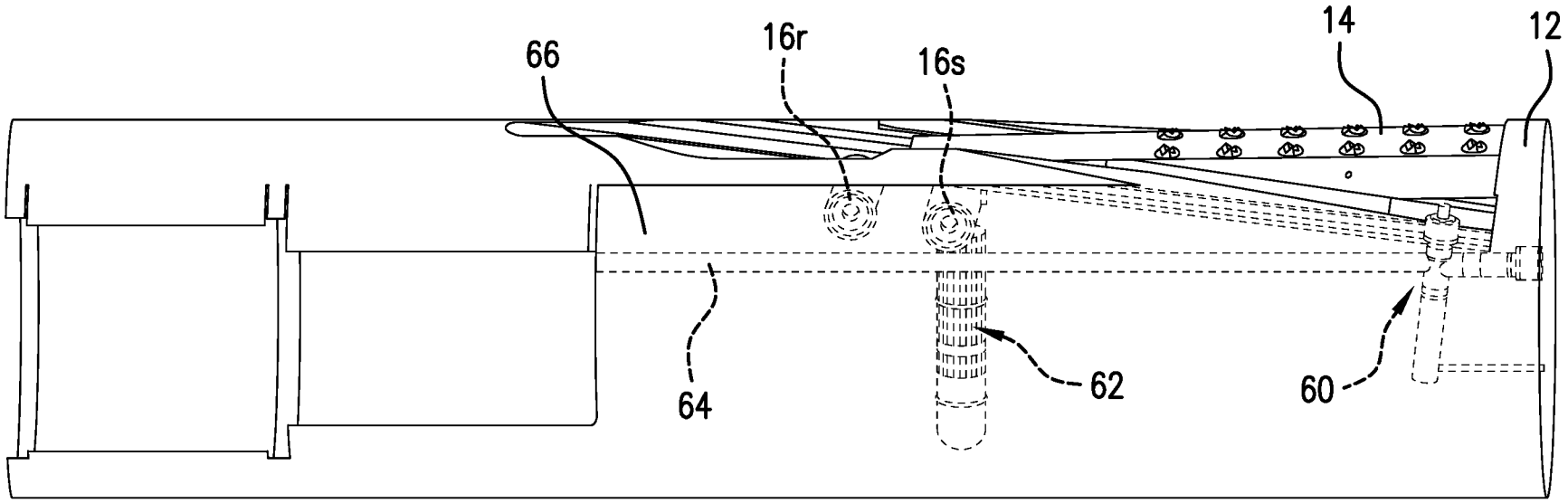
FIG. 12 is a partially transparent view illustrating another embodiment that combines the functions of the FIG. 1 and FIG. 4 embodiments.
Figure 13:
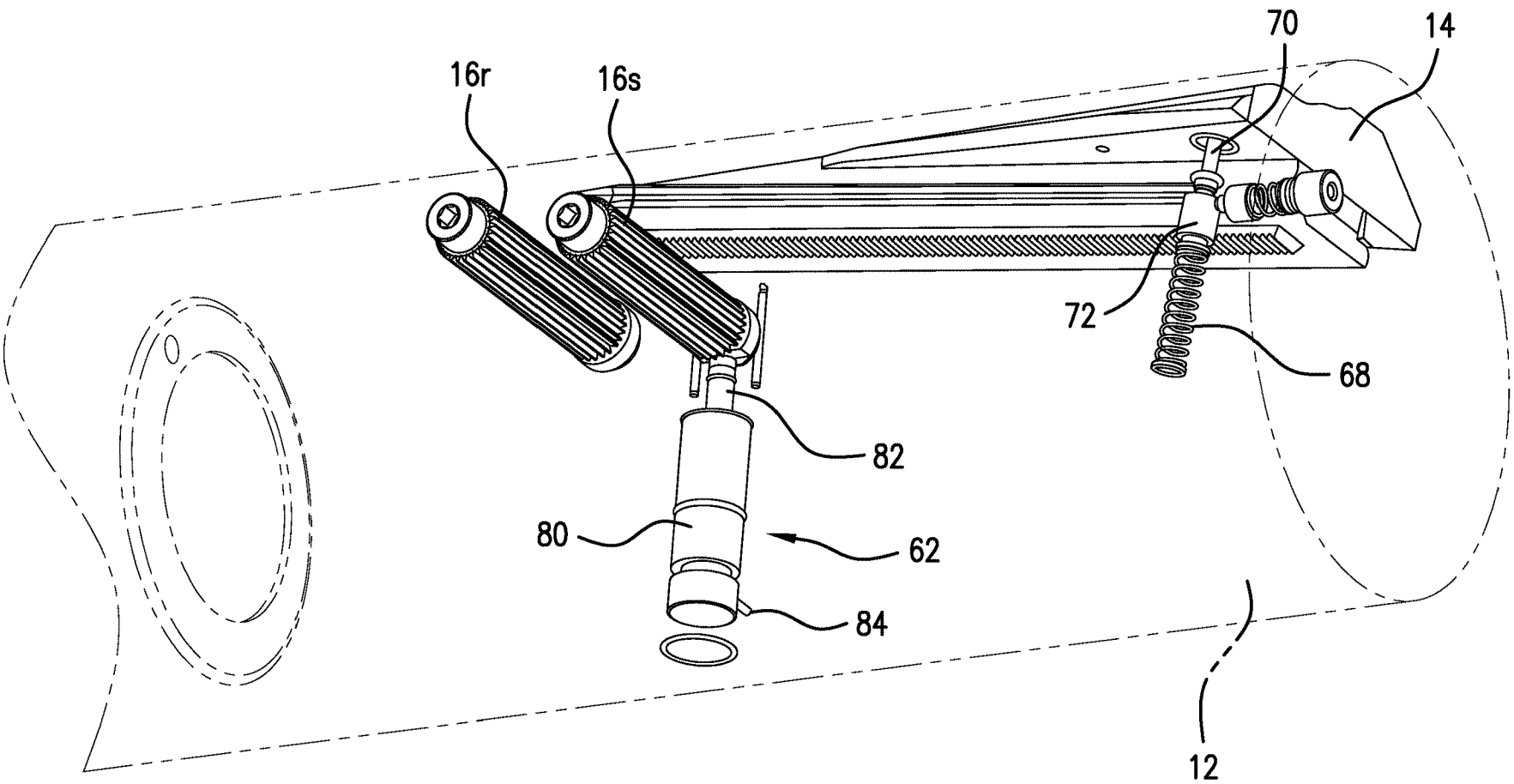
FIG. 13 is an alternate perspective view of the embodiment of FIG. 12.
Figure 14:
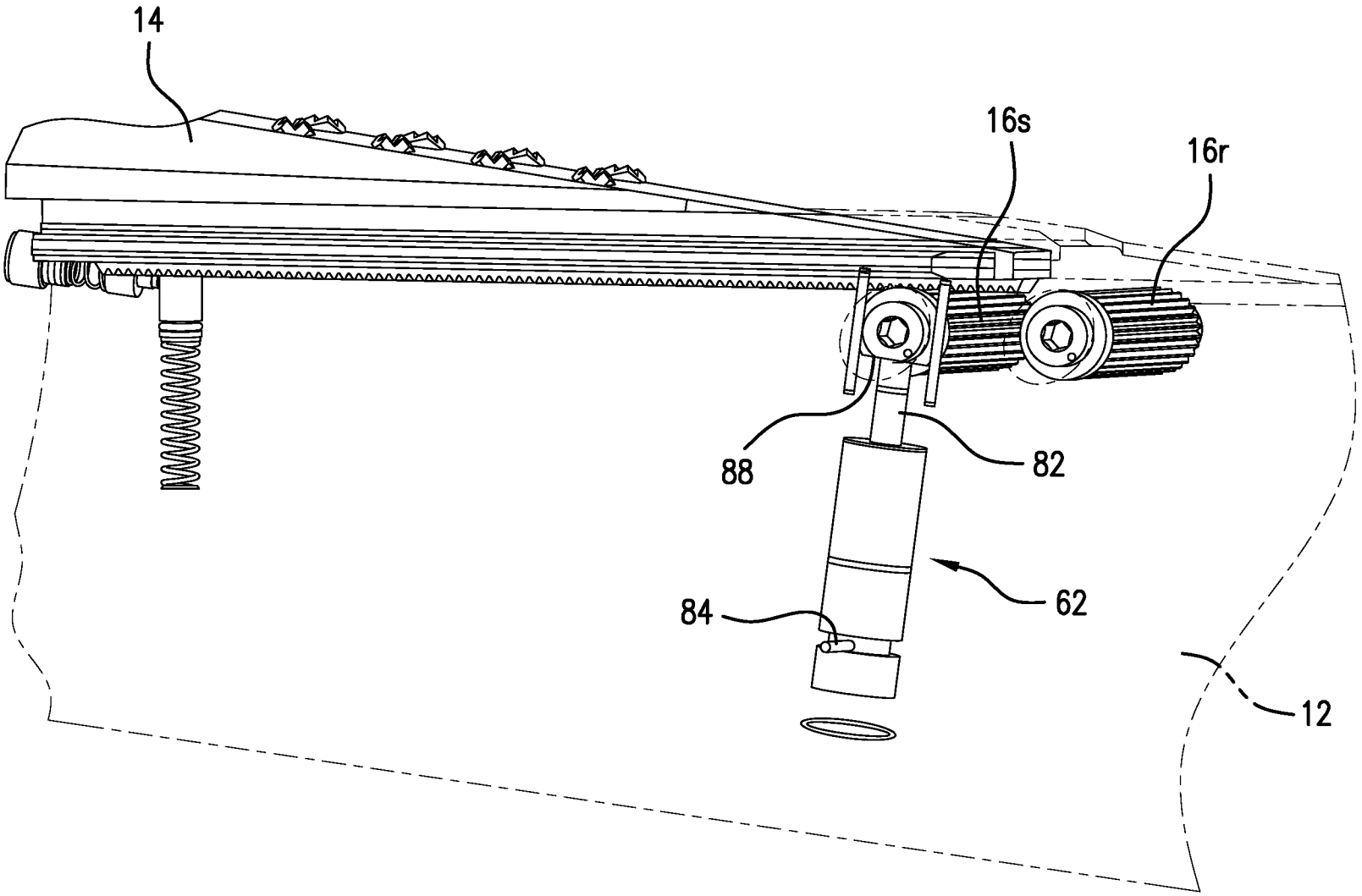
FIG. 14 is a view from the opposite side from FIG. 13.

Referring to FIGS. 12-14, another embodiment is illustrated that combines the embodiments of FIGS. 1-3 with the embodiment of FIGS. 9-11 to create an anchor having a slip 14 that is power driven to the setting position as well as power retracted. In addition, the illustrated embodiment in FIGS. 12-14 is pressure triggered but it is to be understood that it is not required that the components hereof be directly pressure triggered as shown.

Referring to FIG. 12, the housing 12 is similar to the foregoing in that it presents a conical surface 32 and a slip 14. A power drive gear 16 is employed which is similar to that employed in FIG. 1 and will drive the slip to a set position but there is also a complementary (second one, second two, second three, how many ever drive gears in one direction can be duplicated for drive in the other direction) gear 16. For clarity, in this embodiment the two gears will be denoted 16*s* (for "set") and 16*r* (for "retract"). In this embodiment there is also a slip release piston assembly 60 and a drive gear freewheel piston assembly 62. In an embodiment, both the release piston assembly 60 and the freewheel piston assembly are both actuated by hydraulic pressure through access conduits 64 and 66. Pressure acts on both conduits equally but the thresholds for each piston assembly 60 and 62 are different. In particular, the pressure threshold to move piston assembly 60 is lower than that for piston assembly 62. In an embodiment the difference may be about 500 pounds per square inch (PSI). It is however, to be understood that other pressure deltas are contemplated. Gear 16*s* is loaded in the same way as for that of FIG. 1 and is storing potential energy in the same way. It will drive the set of slip 14 once the slip 14 is released by the piston assembly 60.

Referring to FIG. 13, piston assembly 60 includes a compression biaser 68 to keep a pin 70 resident in the slip 14, thereby preventing slip 14 movement. Pressure applied to assembly 60 through conduit 64 at a threshold pressure will cause a piston body 72 to move against the bias of biaser 68 and pull pin 70 out of the slip 14. The slip is then free to move under the influence of drive gear 16*s*. In an embodiment, the assembly 60 also includes a lock piston 74 that must be urged to disengage piston body 72 before the body 72 may move under the influence of pressure in conduit 64.

Once assembly 60 has released the slip 14, the action will be just as it was in FIG. 1-3, however, while the slip 14 is being driven up the conical surface 32, the second drive gear 16*r* will be receiving energy to be stored in the form of a wound spring. The spring constant of the spring within 16*s* is significantly greater than that of the spring in 16*r* so that the setting movement of the slip 14 is not inhibited by having to drive the gear 16*r* at the same time. The difference in spring constant is about 80%-150%, in an embodiment.

When it is desired to unset the slip 14, and move the housing 12, pressure is again supplied, and this time will be at a substantially higher pressure so that the piston assembly 62 will react. Referring to FIGS. 13 and 14, piston assembly 62 includes a piston body 80 having a gear stop 82 thereon. The body 80 is retained by a releaser 84 having a specific pressure at which release will occur. In an embodiment the releaser is a shear pin. Moving to FIG. 14, an opposite side of the anchor 10 is illustrated. This view facilitates an understanding of the drive gear 16*s* and the distinct shape of the drive plug 86 from that of drive plug 42 in FIGS. 6 and 7. Specifically, the plug 86 includes a flat 88 thereon that interacts with the stop 82 preventing rotation of the plug 86 and therefore the drive gear 16*s* other than based upon the kinetic energy imposed by the biaser 38. In this embodiment, however, with threshold pressure applied through conduit 66, the assembly 62 will pull the stop 82 away from the flat 88 and let the plug 82 and the drive gear 16*s* freewheel. In this condition, the lower spring rate of the drive gear 16*r* takes over and will cause the retraction of the slip 14.

Figure 15:
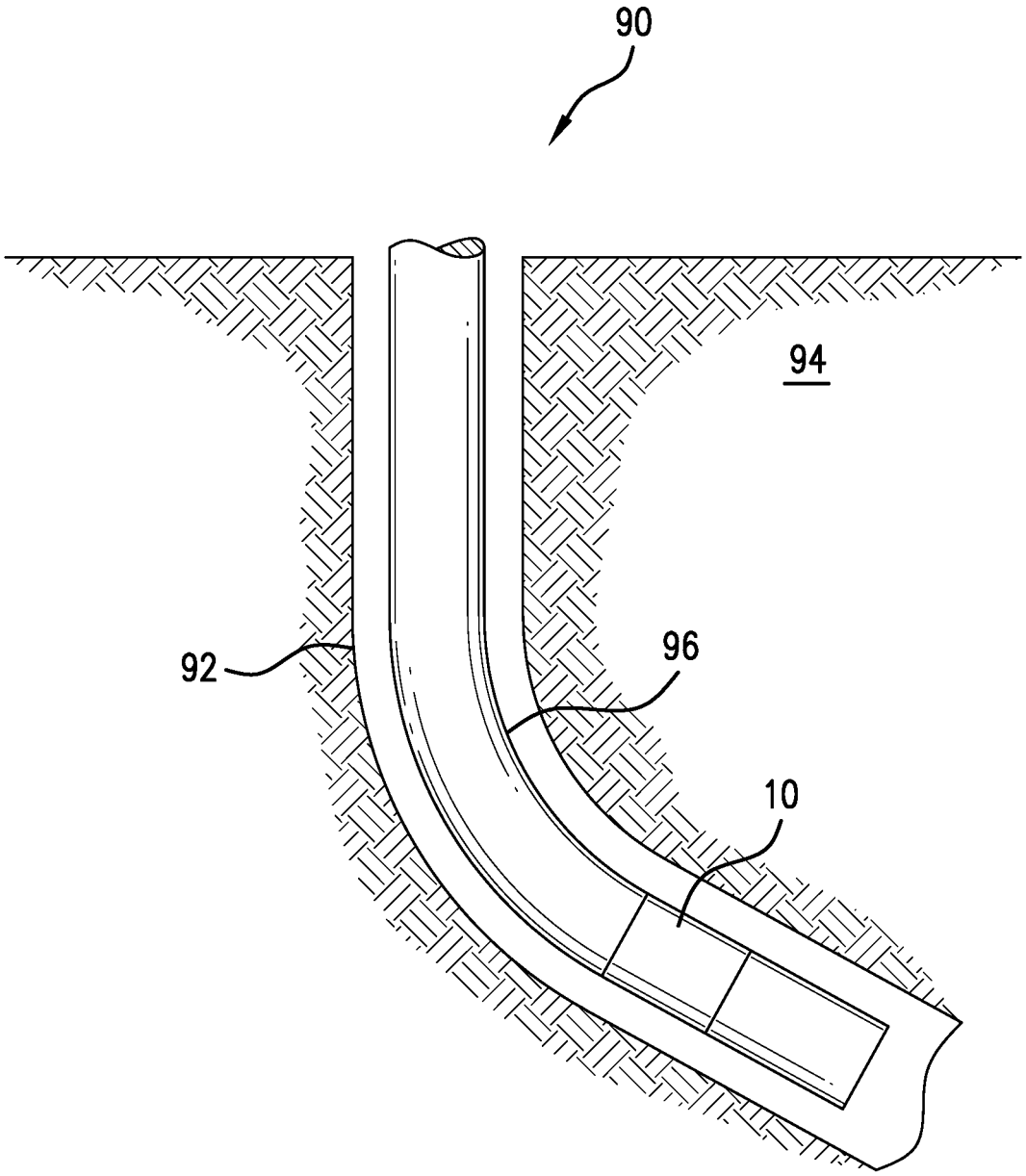
FIG. 15 is a view of a borehole system including the anchor as disclosed herein.

Referring to FIG. 15, a borehole system 90 is illustrated. The system 90 comprises a borehole 92 in a subsurface formation 94. A string 96 is disposed within the borehole 92. An anchor 10 as disclosed herein is disposed within or as a part of the string 96.

Set forth below are some embodiments of the foregoing disclosure:

Embodiment 1: An anchor, including a housing, a slip in contact with the housing, and a power drive gear mounted in the housing and disposed to drive the slip.

Embodiment 2: The anchor as in any prior embodiment, wherein the power drive gear includes a biaser therein.

Embodiment 3: The anchor as in any prior embodiment, wherein the biaser is a coil spring.

Embodiment 4: The anchor as in any prior embodiment, wherein the power drive gear includes a wind input.

Embodiment 5: The anchor as in any prior embodiment, further including a piston disposed in the housing.

Embodiment 6: The anchor as in any prior embodiment, wherein the piston is releasably connected to the slip.

Embodiment 7: The anchor as in any prior embodiment, wherein the piston is releasably connected to the housing.

Embodiment 8: The anchor as in any prior embodiment, wherein the slip includes teeth that are complementary for the power drive gear and engaged therewith.

Embodiment 9: The anchor as in any prior embodiment, wherein the power drive gear is configurable to be charged with potential energy in a direction that upon release will drive the slip toward a set position or in a direction that upon release will drive the slip toward an unset position.

Embodiment 10: The anchor as in any prior embodiment, wherein the power drive gear is a plurality of power drive gears at least one of which is configured to drive the slip into a set position and at least one of the plurality is configured to drive the slip to an unset position, the at least one power drive gear configured to drive the slip to a set position being releasable to freewheel.

Embodiment 11: The anchor as in any prior embodiment, wherein the at least one power drive gear configured to drive the slip to a set position is initially prevented from freewheeling by a freewheel piston assembly, the freewheel piston assembly being disengageable form the at least one power drive gear configured to drive the slip to a set position to facilitate the freewheel.

Embodiment 12: A method for operating an anchor, including supplying an input to the anchor, driving a slip of the anchor to a position other than a position occupied by the slip immediately prior to the input, wherein the driving comprises rotating a power drive gear.

Embodiment 13: The method as in any prior embodiment, further comprising charging the power drive gear.

Embodiment 14: The method as in any prior embodiment, wherein the charging is by driving the power drive gear with the slip during manufacture of the anchor to a higher potential energy condition.

Embodiment 15: The method as in any prior embodiment, wherein the charging is by driving the power drive gear with a tool connected to the power drive gear.

Embodiment 16: The method as in any prior embodiment, wherein the input is pressure.

Embodiment 17: The method as in any prior embodiment, wherein the driving is to a set position of the slip.

Embodiment 18: The method as in any prior embodiment, wherein the driving is to an unset position of the slip.

Embodiment 19: The method as in any prior embodiment, wherein the driving is both to a set position of the slip and to an unset position of the slip.

Embodiment 20: A wellbore system, including a borehole in a subsurface formation, a string in the borehole, and an anchor as in any prior embodiment disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An anchor, comprising:

a housing;

a slip in contact with the housing; and a power drive gear mounted in the housing and disposed to drive the slip, the power drive gear including a wind input; and a biaser in direct contact with the power drive gear.

2. The anchor as claimed in claim 1, wherein the biaser is a coil spring.

3. The anchor as claimed in claim 1, further including a piston disposed in the housing.

4. The anchor as claimed in claim 3, wherein the piston is releasably connected to the slip.

5. The anchor as claimed in claim 3, wherein the piston is releasably connected to the housing.

6. The anchor as claimed in claim 1, wherein the power drive gear is configurable to be charged with potential energy in a direction that upon release will drive the slip toward a set position or in a direction that upon release will drive the slip toward an unset position.

7. The anchor as claimed in claim 1, wherein the power drive gear is a plurality of power drive gears at least one of which is configured to drive the slip into a set position and at least one of the plurality is configured to drive the slip to an unset position, the at least one power drive gear configured to drive the slip to a set position being releasable to freewheel.

8. The anchor as claimed in claim 7, wherein the at least one power drive gear configured to drive the slip to a set position is initially prevented from freewheeling by a freewheel piston assembly, the freewheel piston assembly being disengagable form the at least one power drive gear configured to drive the slip to a set position to facilitate the freewheel.

9. An anchor, comprising:

a housing;

a slip in contact with the housing; and a power drive gear mounted in the housing and disposed to drive the slip, wherein the slip includes teeth that are complementary for the power drive gear and engaged therewith.

10. A method for operating an anchor, comprising:

supplying an input to the anchor;

driving a slip of the anchor to a position other than a position occupied by the slip immediately prior to the input, wherein the driving comprises rotating a power drive gear having a wind input, with or against a bias provided by a biaser in direct contact with the power drive gear.

11. The method as claimed in claim 10, further comprising charging the power drive gear.

12. The method as claimed in claim 11, wherein the charging is by driving the power drive gear with a tool connected to the power drive gear.

13. The method as claimed in claim 11, wherein the input is pressure.

14. The method as claimed in claim 11, wherein the driving is to a set position of the slip.

15. The method as claimed in claim 11, wherein the driving is to an unset position of the slip.

16. The method as claimed in claim 11, wherein the driving is both to a set position of the slip and to an unset position of the slip.

17. A method for operating an anchor, comprising:

supplying an input to the anchor;

driving a slip of the anchor to a position other than a position occupied by the slip immediately prior to the input, wherein the driving comprises rotating a power drive gear wherein the charging is by driving the power drive gear with the slip during manufacture of the anchor to a higher potential energy condition.

18. A wellbore system, comprising:

a borehole in a subsurface formation;

a string in the borehole; and an anchor as claimed in claim 1 disposed within or as a part of the string.

* * * * *